US005673736A

United States Patent [19]

Farkas

[11] Patent Number: 5,673,736

[45] Date of Patent: Oct. 7, 1997

[54] TEMPERATURE-COMPENSATED AUTOMATIC STOP FILL FOR FILLING OF TANKS WITH LIQUIDS UNDER VAPOR OR GAS PRESSURE

[76] Inventor: Edward J. Farkas, 34 Lyonsgate Drive, Downsview, Ontario, Canada, M3H 1C8

[21] Appl. No.: 526,588

[22] Filed: Sep. 11, 1995

Related U.S. Application Data

[63] Continuation-in-part of Ser. No. 454,437, May 30, 1995, which is a continuation of Ser. No. 212,811, Mar. 15, 1994, abandoned.

[51] Int. Cl.[6] ..... B67D 5/00

[52] U.S. Cl. ..... 141/198; 141/5; 141/7; 141/59; 141/46; 137/202; 137/393; 137/587

[58] Field of Search ..... 141/5, 7, 59, 44–46, 141/94, 95, 198, 290; 137/202, 386, 388, 393, 397, 587, 588

[56] References Cited

U.S. PATENT DOCUMENTS

| | | | |
|---|---|---|---|
| 2,801,644 | 8/1957 | Laswell | 137/388 |
| 4,094,346 | 6/1978 | Milo | 137/202 X |
| 4,887,857 | 12/1989 | VanOmmeren | 141/5 X |
| 5,028,244 | 7/1991 | Szlaga | 137/202 X |
| 5,151,111 | 9/1992 | Tees et al. | 141/59 X |
| 5,156,199 | 10/1992 | Hartsell, Jr. et al. | 141/198 X |
| 5,195,564 | 3/1993 | Spalding | 141/45 X |
| 5,205,330 | 4/1993 | Sekine | 141/59 |
| 5,282,497 | 2/1994 | Allion | 141/59 |
| 5,291,922 | 3/1994 | Martin et al. | 141/59 |
| 5,443,561 | 8/1995 | Sakata et al. | 137/202 |
| 5,449,029 | 9/1995 | Harris | 141/198 |

*Primary Examiner*—J. Casimer Jacyna
*Attorney, Agent, or Firm*—Flehr Hohbach Test Albritton & Herbert LLP

[57] ABSTRACT

The invention described in the patent is an automatic control system which provides monitoring, supervision, and control of the process of filling of a tank or container with a liquid. The invention is applicable to cases where the liquid is handled in contact with its own vapor only, or where the liquid must be maintained at all times under a specified gas pressure. The invention provides an improved method of carrying out the process of filling of tanks or containers with liquids such as ammonia, chlorine, propane, liquefied petroleum gas, or with liquids such as carbonated beverages. The main advantage provided by the apparatus and method of the present invention is that an improved means is included for automatically stopping the filling process at the correct point, so as to avoid a possibly hazardous overfilled condition. One of the methods currently in use requires a mechanical valve which senses liquid level in the tank and is supposed to close so as to stop flow to the tank when the liquid has reached the maximum allowable level. The mechanical valve may malfunction and allow overfilling of the tank, and the fact that the valve is malfunctioning may not be readily apparent. The present invention does not require a mechanical valve of the type described above. Further, there is a self-checking and self-monitoring capability so that users of the apparatus and method are warned of any malfunction.

7 Claims, 2 Drawing Sheets

TEMPERATURE-COMPENSATED AUTOMATIC STOP FILL FOR FILLING OF TANKS WITH LIQUIDS UNDER VAPOR OR GAS PRESSURE

This application is a continuation-in-part of Ser. No. 08/454,437, filed May 30, 1995, still pending, which is a continuation of Ser. No. 08/212,811, filed Mar. 15, 1994, now abandoned.

FIELD OF INVENTION

The invention relates to equipment which is used in commerce and industry. The equipment is used for handling liquids, and specifically is used for filling of tanks or containers with liquids. The equipment is designed and intended for use in situations in which the filling process must be stopped before the internal volume of the tank is completely filled with liquid. The equipment is also intended for use in situations in which there is no communication between the interior of the tank and the surrounding atmosphere. The liquid is handled in contact with its own only, or in contact with a gas at a specified pressure. Filling of tanks or containers under such conditions requires specialized techniques. The techniques currently known to those skilled in the art have deficiencies, especially in such applications as filling of fuel tanks of motor vehicles which utilize propane or liquefied petroleum gas (PG) as fuel. The present invention provides an improved apparatus and an improved method for filling of tanks or containers in this application and in related applications.

BACKGROUND

The invention relates to the handling of liquids in industrial and commercial processes. More specifically the invention relates to filling of tanks with liquids. One example of a case where tanks must be filled is the refueling of a motor vehicle which is powered by a fuel which is dispensed to the vehicle in liquid form.

Any liquid expands when it is warmed. Consider a completely closed tank which is nearly filled with a liquid. Suppose the tank is warmed, for example by the sun shining on it. The liquid in the tank expands, and may come to completely fill the available internal volume of the tank. If there is further warming, and the liquid has no further available space within the tank into which it can expand, the liquid develops extremely large forces against the tank walls and the tank may split apart, releasing the liquid in an uncontrolled manner. Such a release is obviously undesirable, especially if the liquid is toxic or flammable.

Every liquid has associated with it a "vapor pressure" which is a function of temperature. The phrase "vapor pressure" has a very specific meaning well known to those skilled in the arts of chemistry and chemical engineering. Vapor pressure is an intrinsic property of a given liquid at a given temperature and can be thought of as an outward force exerted on the surroundings, by the liquid.

If a liquid to be stored in a tank has a vapor pressure higher than atmospheric pressure, at temperatures to which the tank is exposed in normal use, the tank must be kept closed. Otherwise the material stored in the tank would be continuously lost to the surrounding atmosphere. In this type of situation it is important to understand that there is no air in the tank. Part of the tank internal volume is occupied by a given material in liquid form. The other part of the tank interior is occupied by the vapor form of the same material. The liquid is in contact only with its own vapor. The pressure in the tank is equal to the vapor pressure of the liquid, at the temperature of the liquid in the tank.

If a liquid is to have a specified gas pressure applied to it all times, such as when nitrogen or carbon dioxide is used to blanket a liquid subject to oxidation, and if that specified gas pressure is higher than atmospheric pressure, then again the tank must be kept closed. Otherwise the required nitrogen or carbon dioxide pressure could not be maintained. In this case part of the internal volume of the tank is occupied by the material in liquid form. In the other part of the interior of the tank, one finds a mixture of the gas which is used to pressurize or blanket the liquid material, and vapor of the same material. To shorten the following discussion, in this situation there will be reference simply to "gas", which will be understood to be in fact a mixture of gas and vapor. Again it must be understood that typically there is no air in the tank. The pressure in the tank is equal to the specified gas pressure to which it is desired to subject the liquid.

In any of the situations described above, the factor which could create a dangerous pressure build-up in the tank is the internal volume of the tank becoming completely filled with liquid. As long as there is a part of the interior tank volume which is filled with vapor or gas, pressure typically cannot become excessive. With further reference to any of the situations described above, the tank could be equipped with a "blow-off" valve, a "boil-off valve", or a pressure relief valve. If such a valve is present, and if the pressure in the tank becomes excessive for any reason, such as the internal volume of the tank becoming completely filled with liquid, material can be released through the valve, so that there is no danger of tank failure.

However in some applications it would be very undesirable to have to release material from the tank or container. Therefore in these situations extreme care must be taken to ensure that the internal volume of the tank never becomes completely filled with liquid. The maximum allowable amount of liquid in the tank is expressed in terms of a "filling ratio". A typical filling ratio limitation is that the volume of liquid in the tank is not allowed to exceed 80% of the total internal volume of the tank. This filling ratio limitation applies at the time the tank is filled, and is intended to take into account possible warming of the tank which may occur after the tank is filled, such as due to exposure to the rays of the sun. The idea is that if the tank is filled to no more than 80%, then the likely warming which may occur later will not result in the expansion of the liquid volume to more than, for example, 95% of the internal volume of the tank.

The vapor pressure of a liquid at typical temperatures of operation could be less than atmospheric pressure, and it may be desired to handle the liquid in contact with its own vapor only. Under this condition also, the tank must be kept closed. Otherwise air would enter. Similarly, it may be desired to keep a liquid under a specified gas pressure, using, for example, nitrogen or carbon dioxide, and this specified gas pressure may be less than atmospheric pressure. Again the tank must be kept closed to exclude air.

Under these sub-atmospheric pressure conditions it may again be desired to fill a tank up to a specified filling ratio.

The situation inside a tank containing a liquid in contact with its own vapor only, and with no air or other gas present, is a situation which is not met in everyday life. Failure to understand the behavior of this type of system is the root cause of the Three Mile Island Nuclear Power Plant disaster in 1979. In this case the material in the container was liquid water at very high temperature and pressure in contact with water vapor only. Also in 1979 there was a railroad accident in Mississauga, Ontario, involving cars containing chlorine. Failure of the authorities to understand the behavior of liquid chlorine in a tank in contact with its own vapor only resulted in hundreds of thousands of people being unnecessarily kept away from their homes, and thousands of businesses being unnecessarily closed, for a lengthy period.

The behavior of a liquid contained in a sealed tank, in contact with its own vapor only, must be fully understood in order to understand the apparatus and method of the present invention. Especially, it must always be kept in mind that there is no air inside the tank.

The apparatus and the method of the present invention apply to situations where a liquid is maintained in contact with its own vapor only, and to situations where a liquid is maintained under a specified gas pressure. Since the case of contact of a liquid with its own vapor only is more complex, the following discussion primarily relates to this case.

In industrial practice, typically there is a supply tank from which liquid is drawn. This liquid is moved by pump or by other means to a tank which is to be filled. While the tank to be filled may initially be essentially empty, there usually would be some liquid and therefore some vapor in the tank. When at least a portion of the internal volume of the tank is occupied by vapor, it is possible to force further liquid into the tank, which results in vapor in the tank being condensed into the liquid phase in the tank. However in order to proceed more easily and more rapidly with the filling process, vapor from the tank to be filled can be returned to the supply tank, during the filling process. The Vapor flows from the tank being filled, to the supply tank, via a "vapor return line".

The volume of vapor being returned is essentially equal to the volume of liquid entering the tank which is being filled. This condition defines a true or full-fledged vapor return system.

The apparatus and the method of the present invention rely on and require use of a very small flow of vapor from the tank being filled, back to the supply tank, during the filling process. The volume of vapor which returns to the supply tank is a very small fraction of the volume that would return in a full-fledged vapor return system. This very small vapor flow, for example, is not significant in terms of allowing further liquid to flow into the tank. Further liquid can be supplied to the tank by forcing significant quantities of vapor to condense into the liquid, as well as by forcing a small flow of vapor to leave the tank as described above.

In the case of a liquid maintained under a specified gas pressure, gas in the tank cannot be forced into the liquid phase without limit. Therefore the flow of gas out of the tank being filled must be larger.

The small flow of vapor, or the somewhat larger flow of gas, out of the tank being filled, can be referred to as a bleed flow or auxiliary flow. It can be regarded as a signal flow, or an information-carrying flow. The small-diameter hose or tubing which carries this flow can be regarded as a signal line which carries information about the liquid level within the tank being filled.

The allowable filling ratio is different for different liquids. For a liquid with a higher coefficient of thermal expansion, the maximum allowable filling ratio would be lower, a typical value being 50%. In addition, if, at the time a tank is filled, the liquid that is being fed to the tank is unusually cold, the allowed filling ratio or filling density properly should be less than the normal value.

Various methods are currently in use to stop the process of filling a tank with liquid, at the correct point, so that the tank is not overfilled. These methods include:

a. A mechanical valve is permanently installed inside the tank. This valve is on the inlet line or feed line. The valve senses the liquid level and closes when the correct liquid level has been reached in the tank.

b. A liquid level sensor can be placed inside the tank. When the correct liquid level is reached, a signal is sent to a controller, which in turn stops the flow of liquid to the tank.

c. To quote from "Handbook—Butane-Propane Gases", Third Edition, 1942, page 104, in a method which is applied to "tank trucks", "there is a fixed outage tube in each tank, that extends from the top of the shell to the correct point to indicate when loading is finishing, this tube having a valve through which vapor will vent until the liquid reaches the bottom of the tube. The valves are then shut and the liquid and vapor hose disconnected . . . ".

d. If the tank is removable from its usual place of use, and if it is not too large, it can be placed on a scale during filling. The maximum allowable weight of tank and contents is known. The weight of the tank and contents is observed on the scale during the filling operation. When the correct weight has been reached, the filling process is stopped.

There are various disadvantages and deficiencies to the above methods, including:

a. The mechanical valve could malfunction, and allow a larger than correct amount of liquid to enter the tank. It would be very difficult for the user of this method to be aware that the tank is being overfilled.

b. Some sensors would require an electrical connection to the tank. To make this connection each time the tank is filled adds to the complexity of the filling process, and to the hazard, if the liquid being handled is flammable. Again in case of malfunction, the tank might be overfilled without the user being aware of it.

c. The method as described in the reference does not provide automatic operation and therefore is only suitable for use with a trained operator in attendance. In filling of large tanks, which is the subject under discussion in the quoted reference, the feed rate is small relative to the tank volume and there is time for the operator to take action to stop the fill. In filling smaller tanks where the total filling time may be only 1 to 2 minutes, a delay of even a few seconds could result in an overfilled tank. Therefore the described manual method could not be used.

d. This method is only applicable to relatively small tanks, and to tanks that can readily be removed from any equipment with which they are used.

Any method which utilizes a valve or other mechanical equipment on the liquid feed line suffers from adverse effects of contaminants in the liquid feed. Because all the liquid goes through said valve or other mechanical equipment, contaminants tend to build up and this accumulation may in time cause a malfunction.

In view of these deficiencies, the various industries which deal with filling of tanks under the conditions described above are seeking improved methods of controlling the filling of tanks. The ideal control method would have the following attributes:

The control method would automatically stop the fill at the correct point, without supervision by human operators or observers, and would automatically take into account normal and abnormal operating conditions.

The control method would be self-supervising so that in case of malfunction of one of the components of the control system a warning is given and the system automatically shuts down. If the malfunction is such that the tank currently being filled may be overfilled, or has been overfilled, a warning to that effect is given. In any case, the control system automatically refuses to fill further tanks until repairs have been made and the system has been reset by authorized service and repair personnel.

The equipment required to put the control method into practice would not be unduly expensive, and the use of the equipment would not complicate the tank filling process.

Usually the number of tanks to be filled is relatively large. Therefore to put the control method into use the component (s) required on or in each tank should in particular be very simple and inexpensive and should require little or no maintenance.

Any hardware should not have to handle all the liquid which is supplied to the tank, and therefore, because the hardware is handling relatively little or no liquid, there would be a reduced tendency to suffer malfunctions due to contaminants in the liquid.

SUMMARY OF THE INVENTION

The present invention provides automatic control of the filling of tanks with liquids. The filling operation is automatically stopped when the amount of liquid in the tank has reached a specified filling ratio, i.e., when the volume of liquid in the container has reached but has not exceeded a specified percentage of the total internal volume of the tank or container. The apparatus and the method of the present invention have the following attributes:

1. There is no mechanical valve or other apparatus or appurtenance on the feed line to the tank being filled, with the following exception. The apparatus and the method of the present invention involve a microprocessor. The microprocessor receives information indicating when the tank has been correctly filled. At this time the microprocessor shuts off the flow of liquid to the tank, by closing a simple on/off valve which is located outside the tank, and well upstream of the tank, typically upstream of the fill hose which is connected to the tank during the filling process, or by shutting off the feed pump.

2. In different embodiments of the invention, different types of apparatus are permanently installed within the tank to be filled. In all cases, said apparatus is simple, inexpensive, and extremely reliable.

3. The microprocessor contains suitable programming and receives information from sensors located in the dispensing system. There are no sensors in or on the tank which is being filled. On the basis of the information from the sensors, the microprocessor controls, monitors, and supervises the filling process. A filling process is started by a human operator or user of the filling equipment. The microprocessor stops the fill automatically when the tank has been filled to the correct level. The microprocessor stops the filling process immediately if an abnormal condition is indicated, on the basis of the information provided by the sensors, and utilizing the programming with which the microprocessor is equipped. Abnormal conditions which would cause the microprocessor to refuse to start or to immediately stop a filling process include but are not limited to an attempt to fill a tank which is already correctly filled, or sensor failure.

A suitable warning is given in each case, and the control system does not allow further fills to occur until the problem has been investigated .and repaired, and the system reset by authorized personnel.

BRIEF DESCRIPTION OF THE DRAWINGS

A schematic of the present invention is presented in FIG. 1. A float valve is used inside the tank being filled. Two embodiments of the float valve are shown in FIGS. 2 and 3.

DETAILED DESCRIPTION OF THE INVENTION

Figure 1:
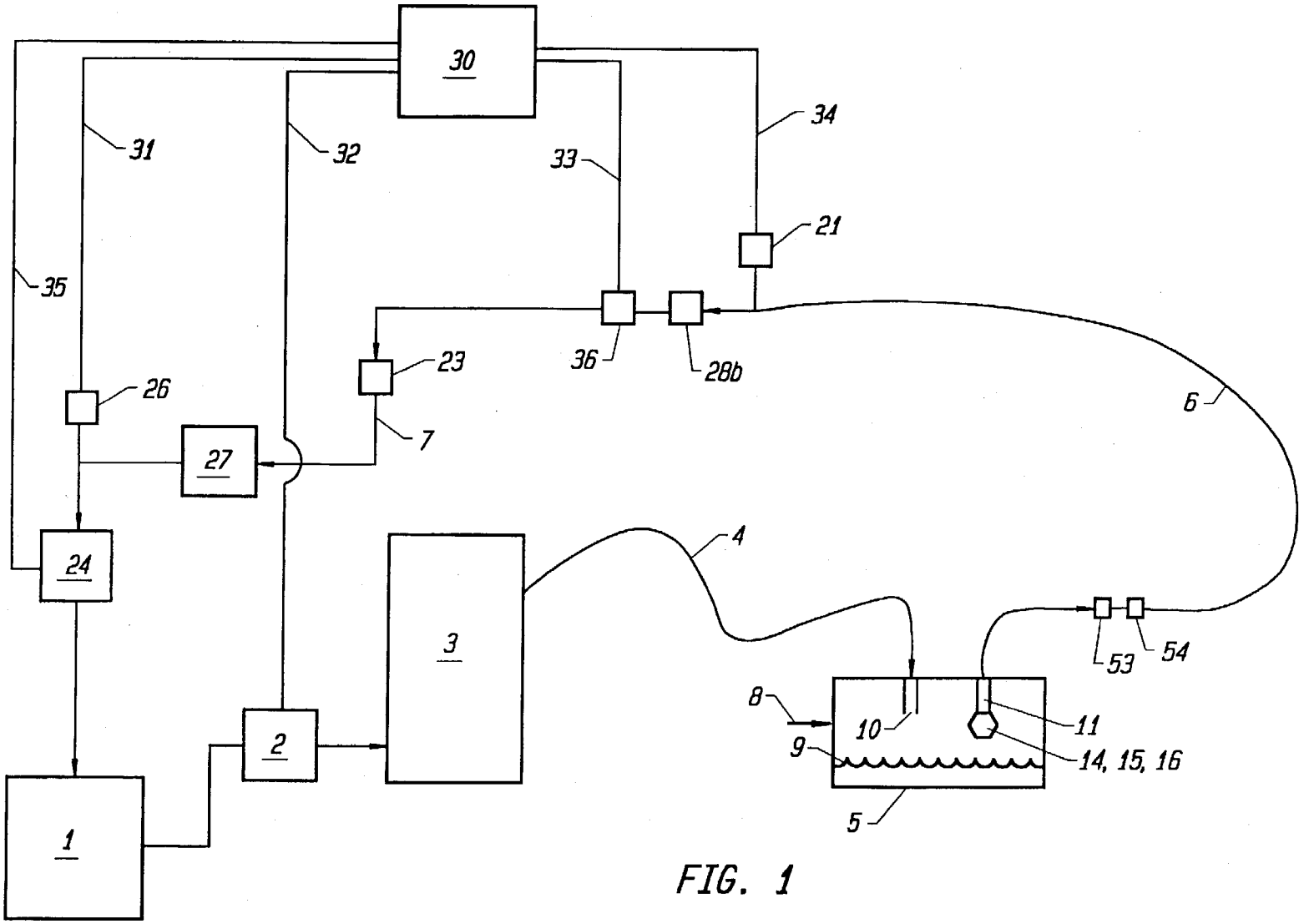

Referring to FIG. 1, the tank 5 is to be filled with a liquid. The dispenser or other filling equipment 3 is supplied with liquid from supply tank 1 by pump 2. The pump could be within the dispenser 3 or could be at a different location. Various other liquid-handling appurtenances which are needed in the type of system sketched in FIG. 1 are well known to those skilled in the art and are not included in FIG. 1.

A key component in the apparatus and method of the present invention is a microprocessor or computer 30, which contains appropriate programming. The microprocessor 30 can be located within the dispenser 3 or elsewhere. The microprocessor receives information from sensors to be described later. The microprocessor performs all functions of the present invention and also performs various Other functions, thus providing complete control, monitoring, and supervision of all aspects of the filling equipment and the filling process.

The liquid is supplied to tank 5 by fill hose 4 or by a fill pipe which takes the place of fill hose 4. There is a very small flow of vapor from the tank 5 which is being filled, back to the supply tank 1, during the filling process. This small flow of vapor can be termed the bleed, auxiliary, or signal flow. This vapor returns via line 6 from the tank 5. For clarity, the auxiliary hose 6 and the components attached to it are shown separate from the dispenser 3 in FIG. 1. However for convenience in installation these components may be placed within the dispenser 3 or at another suitable location in the supply/dispensing system.

If the vapor or gas flowing out of the tank 5 via the auxiliary line 6 is not harmful, toxic or flammable, and if the pressure in tank 5 is greater than atmospheric pressure, the vapor or gas does not have to be returned to the supply tank 1, but can be released to the atmosphere.

The lines or hoses 4 and 6 could be combined into one package for ease of handling. A coaxial arrangement, a side by side arrangement, or other arrangement could be used. Or, the two lines 4 and 6 could be handled separately.

If the vapor or gas is to be returned to the supply tank, an additional length 7 of hose, tubing, or piping is utilized for this purpose.

During the filling process, there must be flow in the line 6 from the tank 5 which is being filled, ultimately to the atmosphere or to supply tank 1.

In order for there to be flow, the pressure in tank 5 must be higher than the pressure in tank 1, if the vapor or gas is to be returned to tank 1, or, as noted above, must be higher than atmospheric pressure, if the vapor or gas is to be released to the atmosphere.

In a given application of the apparatus and method of the present invention, if the pressure in tank 5 is not adequate to ensure flow, then a tank 27 must be used, as shown in FIG. 1. The pressure in the tank 27 is kept below the pressure in the tank 5 which is being filled. The required difference between the pressure in tank 5 and the pressure in tank 27 depends on the properties of the liquid being handled. Typically the pressure in tank 27 is maintained at a value which is on the order of one-half of the pressure in the tank 5.

In many applications the pressure in the tank 27 is higher than atmospheric but for ease of reference the tank is referred to as the vacuum tank. The compressor 24 takes vapor or gas from the vacuum tank 27 and compresses it to the pressure in the supply tank 1, or to atmospheric pressure, so as to dispose of vapor or gas from tank 27, and allow continuing flow from tank 5, through hose 6, to tank 27.

The pressure sensor 26 supplies information via the control wiring 31 to the microprocessor 30. The microprocessor operates the compressor 24 as necessary, via the control wiring 35, to maintain the required pressure in the vacuum tank 27.

In most applications the microprocessor has no direct information on the pressure in tank 5. Instead, in the case of a liquid being handled under its own vapor pressure, the microprocessor receives information on ambient temperature, and/or temperature of the liquid in the feed line 4, and estimates the pressure in tank 5 on the basis of pre-programmed information on the vapor pressure behavior of the liquid being handled.

In the case of a liquid being handled under a specified gas pressure, the required pressure in the tank 5 is pre-programmed into the microprocessor.

In the remainder of the description of the present invention, it is assumed that the vacuum tank 27 and the compressor 24 must be used. If there is adequate pressure difference driving force without these components, the description to be presented below still applies, with very minor modifications that will be obvious to those skilled in the art.

The check valve 23 allows vapor or flow only in the normal direction, i.e., away from the tank 5.

To begin a fill, the hoses or lines 4 and 6 are connected to the tank 5 which is to be filled. The method of connection of hose 6 is such that as soon as it is physically connected there is communication between the interior of hose 6 and the interior of tank 5. Equipment is commercially available for this purpose, as is well known to those skilled in the art, and is represented as the two mating halves 53 and 54 in FIG. 1. When the hose 6 is not connected to the tank 5, a device which is part of the mating half 53 which is permanently attached to tank 5, and a device which is part of the mating half 54 which is permanently attached to the end of hose 6, automatically close off the respective openings, so that there is no communication with the open air.

Mating halves similar in principle are used for hose 4 but are not shown in FIG. 1.

There are various possible sequences of events which follow upon connection of hose 4 to the tank 5. Regardless of which sequence of events occurs, the operation of the apparatus and method of the present invention is the same.

As one example of the sequence of events, a human operator may connect hose 4 to tank 5, and then open a valve (not shown in FIG. 1) at the end of hose 4. The human operator also connects hose 6 to tank 5. Or, there may be one filling connection which incorporates both lines 4 and 6.

Then the human operator operates a switch which in turn signals the microprocessor 30 to start the filling process. During a delay period of 1 to 2 seconds, the microprocessor carries out certain procedures to be described below. If all conditions are normal, the microprocessor activates the feed pump 2 to begin the fill, or otherwise starts the flow of liquid to the tank 5, via the hose 4.

The flow of liquid to the tank is automatically stopped by the microprocessor, by stopping via the control wiring 32 the liquid feed pump 2, or by similarly closing an electrically-operated on/off valve (not shown), located upstream of the hose 4, when either the liquid in the tank reaches the maximum allowable level, or an abnormal condition is detected by the microprocessor.

The human operator then removes the hoses 4 and 6 from the tank 5. In the typical sequence previously described, the human operator at this point closes the valve at the end of hose 4. Upon removal of hose 6 from the tank 5, the said devices within the components 53 and 54 of the connection system automatically close, so that no material from the interior of either hose 6 or tank 5 is released to ambient.

The key aspect of the apparatus and the method of the present invention is how the microprocessor determines when the liquid in the tank has reached the maximum allowable level.

The maximum allowable liquid level 8 in the tank 5 is indicated in FIG. 1. At some time during a typical filling operation, the liquid level may be at the intermediate position 9.

As already noted, the auxiliary hose 6 is in no sense a full-fledged vapor return line. The auxiliary hose 6 has a very small inside diameter, typically 3 mm or ⅛ inch, and in addition there is a restrictor **28*b*** in the flow path. The restrictor can be described in terms of the Cv concept which is well known to those skilled in the art. The Cv of a valve or other fitting is a number which expresses the resistance to flow offered by that fitting. A smaller number indicates that the fitting is more restrictive.

The Cv of restrictor **28*b*** is typically within the range 0.005 to 0.2. These values describe fittings which are extremely restrictive, in comparison with fittings which are met in everyday life, such as fittings in building water supply systems.

Due to the presence of the restrictor **28*b*, the flow capacity of the auxiliary hose 6 is negligible in relation to the flow capacity of the fill hose 4, and in relation to the amount of material in tank 5. Furthermore, for the same reasons the flow capacity of the hose 6** is very small in relation to the flow capacity of a full-fledged vapor return line.

Figure 2:
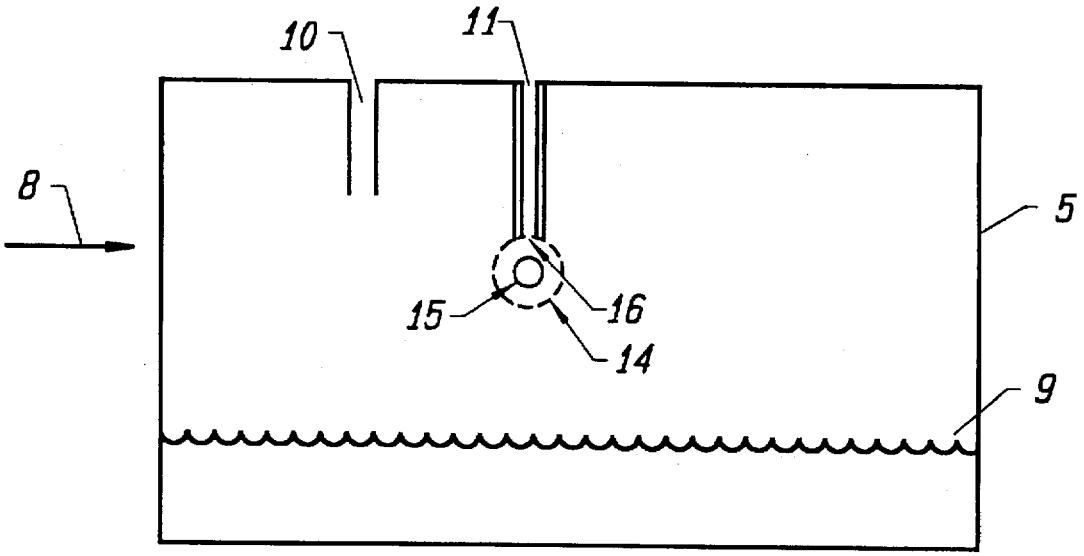
Figure 3:
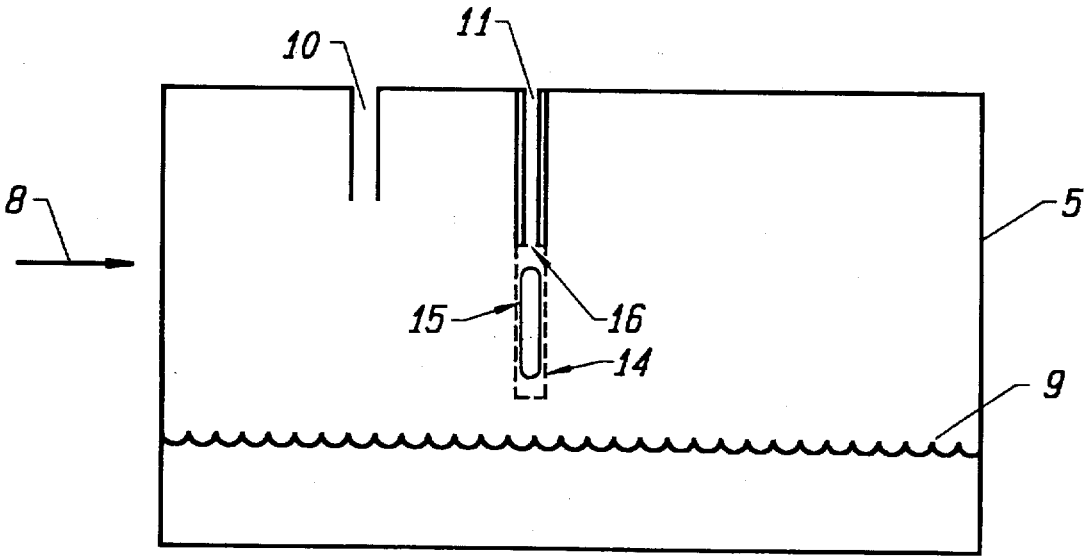

A float valve, as shown in either FIG. 2 or FIG. 3, is installed within the tank 5. There may be an inlet tube 10, and the float valve 14,15,16 is attached to the outlet or exit tube 11 and is so positioned within the tank 5 that when the liquid level rises to the maximum allowable value 8, the float 15 which is within the cage 14 rises to seal against the seat 16.

During the filling operation, while the liquid level is still at an intermediate level 9, below the maximum allowable level 8, vapor or gas flows through the float valve assembly, through the exit tube 11, through the mating halves 53 and 54 of the connection system, and on to the auxiliary hose 6.

Continuing along the flow path of the auxiliary hose 6, there is a hose pressure sensor 21, the restrictor **28*b*, and a sensor 36 which provides a signal via control wiring 33 indicating whether liquid or vapor is flowing in the line. As already noted, information from all sensors goes to a microprocessor or computer 30 which uses the information generally to monitor and control the tank filling operation and specifically to stop the filling operation when the tank 5** has been correctly filled.

Sensor 36 can operate on the basis of capacitance, conductivity, or other property to provide the required indication. If the liquid being handled is a liquid in contact with its own vapor only, the liquid when passing through restrictor **28*b* may flash, with a resulting cooling effect. In this situation the sensor 36** can be a temperature sensor.

The hose 6 can be several meters or more in length, so that the component 21, the restrictor **28*b*, and component 36 are all several meters or more away from the tank which is being filled. The latter three components can be placed within the dispensing system 3** or at another convenient location.

During the filling operation, the pressure in the hose 6 is essentially equal to the pressure in the tank 5, because the float valve assembly 14, 15, 16, and the exit tube 11, offer little or no resistance to flow, while the flow restrictor **28*b* at the downstream end of the hose 6 offers significant resistance to flow. The pressure in tank 27 is maintained at a lower pressure and therefore there is flow through the restrictor 28*b*. The vapor or gas flows continuously to the vacuum tank 27. The compressor 24 then provides the motive power to move the vapor or gas intermittently from the tank 27 and to keep its pressure significantly below the pressure in the tank 5**.

When the liquid level rises to the maximum value 8, and the float 15 seals against the seat 16, the supply of vapor or gas to the hose 6 is cut off and the pressure in hose 6 drops precipitously. The drop in pressure is sensed by the pressure sensor 21. The pressure information is conveyed via the control wiring 34 to the microprocessor 30, and the microprocessor immediately stops the fill.

The sensor 21 can also be a flow meter. The reduced flow of vapor or gas into the hose 6 can be sensed by a change in flow rate, as well as by a change in pressure.

It is important to emphasize that the apparatus and the method of the present invention do not require the entrance of liquid into the hose 6. In the intended and normal functioning of the present invention, liquid rises no higher than the maximum allowable level 8 in tank 5, and specifically does not enter the exit tube 11. As soon as the liquid reaches the maximum allowable level 8, the float valve closes, the hose pressure drops, and on the basis of this drop in pressure the microprocessor immediately stops the filling operation.

Between filling operations, if all equipment is in good condition, there is no leakage into hose 6 and, as a result, for long periods operation of the compressor is not necessary.

When a new filling operation starts, as already noted there is a delay period while the microprocessor makes various system checks, before starting the flow of liquid to tank 5. The most important of these checks is to ascertain that the hose 6 has been properly connected to the tank 5 which is to be filled. When the hose 6 is connected, the hose pressure immediately rises to a level above the value which existed between filling operations. This behaviour occurs because upon connection to the tank 5 the hose 6 immediately begins to receive a steady flow of vapor or gas, and because of the presence of the restrictor **28*b*. In this way the microprocessor determines that the hose 6** has been connected, and that it is permissible to start the fill.

Abnormal Conditions

In the apparatus and the method as described to this point, there are many possibilities for malfunctions which could result in the supply of liquid to the tank 5 continuing, after the liquid has reached the maximum allowable level 8, with the result being an overfill. The apparatus and the method of the present invention include provision for detection of an overfill. When an overfill is detected, an alarm is sounded and the dispensing system shuts down. The human operator or user of the system is alerted that the dispensing system, the tank and the float valve within the tank must be examined to determine and correct the cause of the malfunction.

The apparatus and the method Of the present invention thus are self-monitoring. A potential overfill is detected while the tank being filled is still on the filling station premises. In existing technology, there is no such self-monitoring feature. In the event of a malfunction, tanks could be overfilled repeatedly and the operator or user of the system would not be aware of the hazard thus created.

The heart of the self-monitoring feature in the apparatus and method of the present invention is that the float 15 is purposely designed not to fit absolutely tightly into the seat 16, in either FIG. 2 or FIG. 3. Another key aspect of the apparatus and method of the present invention is that the float 15 contacts the seat 16 before the liquid level reaches the level of the seat 16.

In any case a tight seal is not necessary to obtain the normal operation of the apparatus and the method of the present invention. If the opening at the seat 16 into the exit tube 11 is only partially closed when the float 15 rises to contact the seat, so that vapor or gas volumetric flow rate drops to, for example, 20 to 30% of the value which obtained while the liquid level was well below the maximum allowable level 8, the result will still be a strong drop of pressure in the hose 6, which will be sensed by pressure sensor 21.

If a malfunction then occurs so that liquid continues to flow into the tank 5, despite the pressure change in the hose 6, the liquid level will continue to rise and liquid will ultimately contact the seat 16.

If the operation involves a liquid in contact with its own vapor only, the liquid tends to flash or evaporate explosively as it flows through the relatively small gaps between the float 15 and the seat 16, into the lower pressure region represented by the hose 6. There is a resulting large new supply of vapor to hose 6, and the hose pressure rises again. This increase of pressure following a drop in pressure provides a strong signal that there is a potential for overfill.

If the operation involves a liquid under a specified gas pressure, the liquid flows through the gaps between the float 15 and the seat 16 and is ultimately detected by the liquid detector 36. The result is again a signal of a potential for overfill.

One possible malfunction is that the on/off valve upstream of the feed hose 4 fails to close despite being given a signal to do so. Protection against this malfunction is afforded in the scenario described above.

The float 15 could become lodged in the cage 14 or the whole float valve assembly could be at an incorrect angle so that there is no seating action at all. In this case liquid will freely enter the exit tube 11 and the hose 6 and will be detected by the liquid detector 36.

The pressure sensor 21 could fail and therefore the information on pressure change in hose 6 would not be transmitted to the microprocessor 30. This malfunction is guarded against by use of two pressure sensors, with monitoring of the difference between the outputs of the sensors. In the event of a significant difference developing, indicating that one sensor has failed, the system is automatically shut down for repair. Programming is also provided in the microprocessor which causes the microprocessor to shut down the system if a sensor signal goes out of range, a frequent indication of sensor failure.

Also in the event of failure of the pressure sensor, liquid would enter the hose 6, which would ultimately be noted by the liquid sensor 36. Thus the sensor 36 provides a backup to the sensor 21, the latter sensor being the basis for normal operation.

Provision to prevent overfill in the event of microprocessor failure can include two microprocessors operating in parallel, with a third microprocessor monitoring for any differences in the operation of the two microprocessors.

If a tank is presented for filling and the tank is already full, the pressure in hose 6 does not rise sufficiently for the microprocessor to allow the fill to start. Or, liquid enters the hose 6 and is detected by the liquid detector 36. In either case, there is no further supply of liquid to the tank.

The float valve is a very simple device and there is very little if any potential for failure to operate due to mechanical reasons. As discussed above, the float valve is not intended to be a precise device offering a leak-proof seal. Therefore there is little potential for failure due to fouling.

An override is used to accommodate a brand new tank which is completely empty. When handling a liquid which is in contact with its own vapor only, when the hose 6 is connected the hose pressure does not rise. Without the override, the microprocessor would not allow the fill to begin.

The override is operable by authorized personnel only and allows dispensing of a small quantity of liquid, typically 1 L. This small fill is completed and then a new fill is started. The standard procedure is followed in this new fill.

Temperature Compensation

The float 15 in FIG. 3 is elongated in the vertical direction. The float is a relatively long hollow tube, maintained in a vertical or nearly vertical position.

Any type of float rides higher with respect to the surface of the liquid, if the liquid is denser. The relatively long hollow tube used as a float in FIG. 3 provides a relatively greater movement with respect to the surface of the liquid, as the liquid density changes, as compared to a float with a smaller total height. This fact is taken advantage of in the following way.

As described earlier, the concern is that if the liquid in a sealed tank becomes warmer it expands and may fill the tank completely. Any further expansion would develop tremendous forces within the tank which would cause its catastrophic failure.

If the liquid which is supplied to a tank is already warm, there is less chance of a large thermal expansion which would fill the tank. Therefore, when the liquid is warm, the allowable liquid level in the tank is higher. As already noted, any float rides higher when the liquid is denser and lower when the liquid is less dense. Any float used in the apparatus shown in FIG. 2 or FIG. 3 thus contacts the seat 16 sooner when the liquid is denser and later when the liquid is less dense, as the liquid level rises in the tank. Therefore the tendency of the apparatus shown in the said Figures is to allow a higher liquid level when the liquid is less dense, which is exactly the behavior that is wanted.

It can be shown from elementary principles of physics that the increase in projection of the top of the float above the liquid surface, for a given change in density, is directly proportional to the total height of the float. By appropriate selection of the total height of the float 15 of FIG. 3, it is possible to approach the ideal behavior which is that the tank filling process is stopped when the mass of liquid in the tank reaches a pre-determined value, this value being independent of the temperature of the liquid in the tank.

General Comments and Summary

The present invention requires a pressure difference so that there is an auxiliary or bleed flow in hose 6. In most applications the pressure difference is created by maintaining, through use of vapor compressor 24, a lower pressure in the vacuum tank 27.

In some applications, the action of the feed pump 2 boosts the pressure in the vapor space in tank 5 so that it is greater than the pressure in tank 1. Then the vacuum tank 27 and compressor 24 are not needed.

Generally, in the very rare and unusual circumstance that the computer misses the change in pressure in hose 6, when the tank has become correctly filled, the filling operation continues and liquid flows through hose 6 and reaches the vapor/liquid sensor 36. Upon receiving a signal that liquid is present, the computer stops the filling operation.

Thus there is a backup or second detection method to determine when the tank has been correctly filled. Because of the small internal volume of hose 6, only 2 to 3 seconds are required for liquid to reach sensor 36. Therefore, the delay before the filling procedure is stopped is minimal.

There may be a length of hose or tubing between the tank 5 and the mating half 53 in FIG. 1. This length of hose or tubing could contain liquid, even if the tank, when presented for filling, contains very little liquid. At the start of the fill this liquid moves through hose 6 and while much of it may evaporate some liquid could still contact sensor 36. The microprocessor is programmed to disregard during the first few seconds of the fill any indication of liquid. The amount of liquid can be minimized by ensuring that any hose or tubing upstream of the mating half 53 has a very small inside diameter, and that the length of this hose or tubing is no greater than absolutely necessary.

After the first few seconds of the fill, the microprocessor shuts off the flow of liquid to tank 5, if liquid is still being sensed by sensor 36. This observation indicates that the tank presented for filling already contains the maximum allowable amount of liquid or may indicate a malfunction.

Test Results

The apparatus and the method of the present invention were tested repeatedly, using water and air, in a manner which simulates the behaviour of the float valve of FIG. 2 or of FIG. 3. In the test work, the pressure in the city water system, rather than a liquid feed pump, provided the motive force for liquid flow to the test tank. Downstream of the restrictor **28*b*, the air, and water if any, were released to ambient. The restrictor 28*b*** had a Cv value of approximately 0.02.

At the start of a typical test, city water was supplied to the tank 5. Air was forced out of tank 5 and flowed through the restrictor **28*b* and then to ambient. The pressure in the hose 6 was typically 45 psia. When the water level in the tank reached the maximum allowable value, a device which simulates the behaviour of the float valve of FIG. 2 or of FIG. 3 closed off the flow of air from the tank 5 into the hose 6. The hose pressure (pressure in hose 6**) immediately dropped to 15 psia (essentially ambient pressure). This typical observation supports the basic theory of operation of the apparatus and method of the present invention.

In the test work, the water supply to the tank 5 was not stopped at this time. Water flow was allowed to continue, in order to observe all aspects of system behaviour. After a few seconds, hose pressure rose again to about 40 psia, and soon after water was seen to issue from the downstream end of the restrictor **28*b***. This observation supports the theory of operation of the backup aspect of the invention, i.e., how the apparatus and method of the present invention would cope with an abnormal situation such as a malfunction.

I claim:

1. An apparatus for filling a tank with a liquid, said apparatus comprising:

a tank with a tank inlet and a tank outlet;

a liquid feed pump;

an inlet line with a first end connected to said liquid feed pump and a second end connected to said tank inlet, said inlet line delivering, with a first flow capacity, a liquid from said liquid feed pump to said tank;

an outlet line connected to a first side of said tank outlet, said outline line having a second flow capacity that is negligible in relation to said first flow capacity;

a sensor positioned within said outlet line at an downstream position from said tank outlet such that it is not exposed to splash-back of said liquid while said liquid is delivered to said tank, said sensor identifying a filling pressure while said liquid is delivered to said tank, said filling pressure being substantially equivalent to the pressure in said tank while said liquid is delivered to said tank;

a non-sealing float valve connected to a second side of said tank outlet, said non-sealing float valve causing a non-sealing obstruction of said outlet line when said liquid reaches a predetermined level, and allowing said liquid to flow into said outlet line if the liquid flow through said inlet line is not stopped, said non-sealing obstruction causing within said outlet line an obstruction pressure substantially less than said filling pressure, said obstruction pressure causing said sensor to generate a full tank signal; and a microprocessor connected to said sensor to identify said full tank signal and generate a command signal to stop said liquid feed pump such that said liquid flow is halted at said first end of said inlet line.

2. The apparatus of claim 1 wherein said outlet line has an interior diameter of approximately 3. mm.

3. The apparatus of claim 1 further comprising a liquid sensor to generate said full tank signal in response to a liquid flow in said outlet line.

4. The apparatus of claim 1 wherein said non-sealing float valve includes a vertically elongated float configured to contact the seat of said float valve when the mass of liquid in said tank has reached a pre-determined maximum value substantially independent of the temperature of said liquid.

5. The apparatus of claim 1 wherein said non-sealing float valve is configured to cause a non-sealing obstruction of said outlet line at a higher liquid level when said liquid has a relatively low density.

6. A method of filling a tank with a liquid, said method comprising the steps of:

delivering, through an inlet line with a first flow capacity, a liquid to a tank;

sensing, in an outlet line with a second flow capacity that is negligible in relation to said first flow capacity, a filling pressure while said liquid is delivered to said tank, said filling pressure being substantially equivalent to the pressure in said tank while said liquid is delivered to said tank;

causing a non-sealing obstruction of said outlet line which will allow said liquid to flow into said outlet line if the liquid flow through said inlet line is not stopped when said liquid reaches a predetermined level such that an obstruction pressure substantially less than said filling pressure is formed in said outlet line, said obstruction pressure causing a full tank signal; and responding to said full tank signal by stopping said liquid flow at the front of said inlet line.

7. The method of claim 6 further comprising the step generating said full tank signal in response to a liquid flow in said outlet line.

* * * * *